US007434902B2

(12) United States Patent
Baker et al.

(10) Patent No.: US 7,434,902 B2
(45) Date of Patent: Oct. 14, 2008

(54) PRINTHEADS AND SYSTEMS USING PRINTHEADS

(75) Inventors: Richard Baker, West Lebanon, NH (US); Walter Clinton Dodd, Springfield, VT (US)

(73) Assignee: Dimatix, Inc., Lebanon, NH (US)

( * ) Notice: Subject to any disclaimer, the term of this patent is extended or adjusted under 35 U.S.C. 154(b) by 0 days.

(21) Appl. No.: 11/292,547

(22) Filed: Dec. 2, 2005

(65) Prior Publication Data

US 2006/0132522 A1 Jun. 22, 2006

Related U.S. Application Data

(60) Provisional application No. 60/633,137, filed on Dec. 3, 2004.

(51) Int. Cl.
*B41J 25/308* (2006.01)
*B41J 11/20* (2006.01)

(52) U.S. Cl. ..... 347/8; 400/55

(58) Field of Classification Search ..... 347/8; 400/55

See application file for complete search history.

(56) References Cited

U.S. PATENT DOCUMENTS

| | | | | |
|---|---|---|---|---|
| 4,086,997 | A * | 5/1978 | Wu | 400/57 |
| 5,265,315 | A | 11/1993 | Hoisington et al. | |
| 5,468,076 | A * | 11/1995 | Hirano et al. | 400/59 |
| 5,541,626 | A * | 7/1996 | Hiramatsu et al. | 347/8 |
| 6,523,921 | B2 * | 2/2003 | Codos | 347/8 |
| 6,561,606 | B1 * | 5/2003 | Yoshida | 347/8 |
| 6,921,217 | B2 * | 7/2005 | Tsuji | 400/59 |
| 7,052,117 | B2 | 5/2006 | Bibl et al. | |
| 2004/0233244 | A1 * | 11/2004 | Elgee et al. | 347/8 |

OTHER PUBLICATIONS

U.S. Appl. No. 60/633,137, Baker et al., Filed Dec. 2004; Copies of Application, Claims, and PAIR Transaction History attached.

* cited by examiner

*Primary Examiner*—Julian D Huffman
(74) *Attorney, Agent, or Firm*—Fish & Richardson P.C.

(57) ABSTRACT

A printing apparatus comprises a jetting assembly including a plurality of nozzles for ejecting droplets on a substrate moving relative to the jetting assembly, a mechanism for increasing the displacement of the jetting assembly relative to the substrate, and a sensor configured to activate the mechanism for increasing the displacement of the jetting assembly upon detecting a predetermined dimension of the substrate surface relative to the jetting assembly.

17 Claims, 3 Drawing Sheets

LIFT SYSTEM WITH ALIGNMENT PADS

PRINTHEAD RACK, TOP VIEW

ALIGNMENT PAD DETAIL

PRINTHEADS AND SYSTEMS USING PRINTHEADS

CROSS-REFERENCE TO RELATED APPLICATIONS

Under 35 U.S.C. §119(e)(1), this application claims benefit of Provisional Patent Application No. 60/633,137 entitled "PRINTHEADS AND SYSTEMS USING PRINTHEADS," filed on Dec. 3, 2004, the entire contents of which are incorporated herein by reference.

TECHNICAL FIELD

This invention relates to printheads and systems using printheads.

BACKGROUND

Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electro statically deflected element. A typical printhead includes a reservoir and a jetting assembly. The jetting assembly has an array of ink paths with corresponding nozzle openings and associated actuators, and drop ejection from each nozzle opening can be independently controlled. In a drop-on-demand printhead, each actuator is fired to selectively eject a drop at a specific pixel location of an image as the jetting assembly and a printing substrate are moved relative to one another. In high performance jetting assemblies, the nozzle openings typically have a diameter of 50 microns or less, e.g. around 25 microns, are separated at a pitch of 100-300 nozzles/inch, have a resolution of 100 to 3000 dpi or more, and provide drop sizes of about 1 to 70 picoliters (pl) or less. Drop ejection frequency is typically 10 kHz or more.

Hoisington et al. U.S. Pat. No. 5,265,315, the entire contents of which is hereby incorporated by reference, describes a jetting assembly having a semiconductor body and a piezoelectric actuator. The assembly body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path.

Further examples of jetting assemblies are disclosed in U.S. patent application Ser. No. 10/189,947, entitled "PRINTHEAD," to Andreas Bibl et al., filed on Jul. 3, 2002, the entire contents of which are hereby incorporated by reference.

The amount of bending that a piezoelectric material exhibits for a given voltage is inversely proportional to the thickness of the material. As a result, as the thickness of the piezoelectric layer increases, the voltage requirement increases. To limit the voltage requirement for a given drop size, the deflecting wall area of the piezoelectric material may be increased. The large piezoelectric wall area may also require a correspondingly large pumping chamber, which can complicate design aspects such as maintenance of small orifice spacing for high-resolution printing.

In general, printheads can include one or more jetting assemblies. Printing systems can print in a single pass of the substrate relative to the printhead, or in multiple passes. Printheads can be used to jet inks and/or other fluids, such as materials used for electronic components (e.g., electrically conductive materials) or color filter materials for flat panel displays, for example.

SUMMARY

In a general aspect of the invention, a printing apparatus comprises a jetting assembly including a plurality of nozzles for ejecting droplets on a substrate moving relative to the jetting assembly, a mechanism for changing the displacement of the jetting assembly relative to the substrate, and a sensor configured to activate the mechanism for changing the displacement of the jetting assembly upon detecting a predetermined dimension of the substrate surface relative to the jetting assembly.

Embodiments of this aspect of the invention may include one or more of the following features.

The mechanism for changing the displacement of the jetting assembly includes a lift actuator. The mechanism for changing the displacement of the jetting assembly includes a servo-controlled lead screw assembly. The printing apparatus further includes a conveyor, and the mechanism for changing the displacement of the jetting assembly changes the displacement of the jetting assembly at a speed based on the speed of the conveyer. The printing apparatus includes a mounting rack, and the mounting rack includes alignment elements for re-positioning the mounting rack to the conveyor. The alignment elements include V-blocks. The conveyer includes locator pins configured to be received by the alignment elements. The locator pins are in the form of spherical pins. The mechanism for changing the displacement of the jetting assembly changes the displacement of the jetting assembly at a speed based on the displacement of the jetting assembly. The sensor includes a transmitter and receiver, wherein the receiver is configured to activate the mechanism for changing the displacement of the jetting assembly. The transmitter and receiver mounted on opposite sides of the conveyor.

In another general aspect of the invention, a method for printing on a substrate includes positioning a jetting assembly above a conveyer, placing the substrate on the conveyer, detecting a portion of the substrate extending beyond a predetermined distance from the conveyer, and raising the jetting assembly in response to detecting the portion of the substrate extending beyond the pre-determined distance.

Embodiments of this aspect of the invention may include one or more of the following features.

The method for printing on a substrate additionally includes diverting the substrate from the conveyor in response to detecting a portion of the substrate extending beyond a pre-determined distance from the conveyor.

Among other advantages, although actual printing (i.e., ejection of droplets) can be interrupted, throughput of the substrate can continue with the unprinted substrate being diverted for disposal or reuse. Thus, downtime of the continuous process is minimized. The downtime can be significant when a production line has to be stopped to allow re-webbing of the substrate and re-establishing of the substrate operational set points (e.g., substrate thickness and consistency). Further, the jetting assembly is protected from contamination or possible damage caused by contact between the substrate and jetting assembly. Contamination caused by the substrate contacting the jetting assembly can affect print quality. Increasing the displacement of the jetting assembly relative to the substrate is particularly advantageous in applications in which the substrate is in the form of a material that is raised (e.g., tears, splices) or is positioned on the conveyor in an unexpected orientation (e.g., tilted).

The printing apparatus can also include an alignment system to ensure that the jetting assembly (alone or as part of a print head cluster) will be in the exact position it was in prior to being raised. The alignment system is configured to accurately lower a print head assembly relative to the substrate (e.g., web or individual products) without having to ground the lift actuating system on the product transport system.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
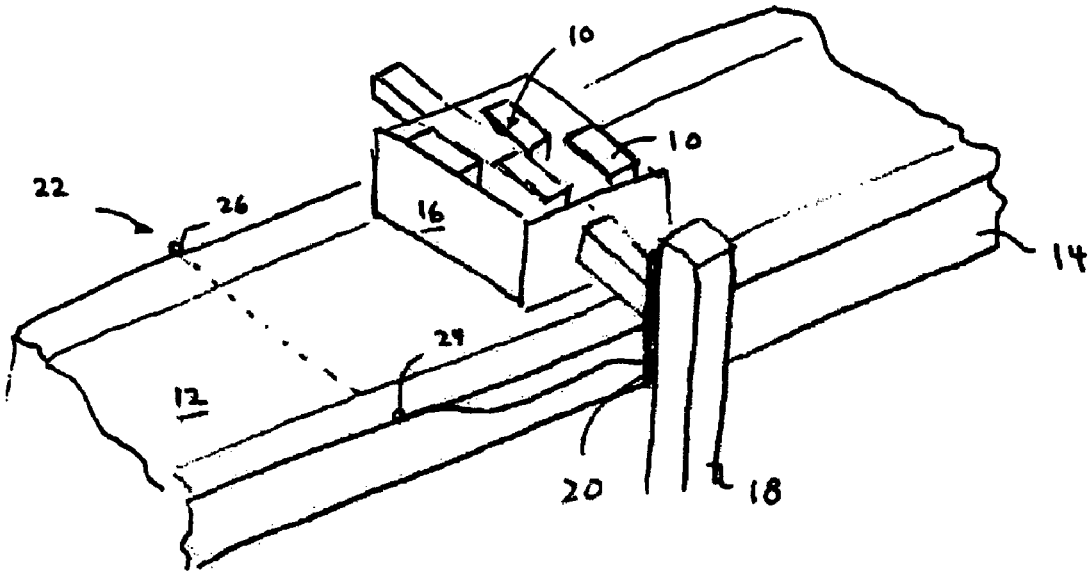
FIG. 1 is a perspective view of a printing assembly.
Figure 2:
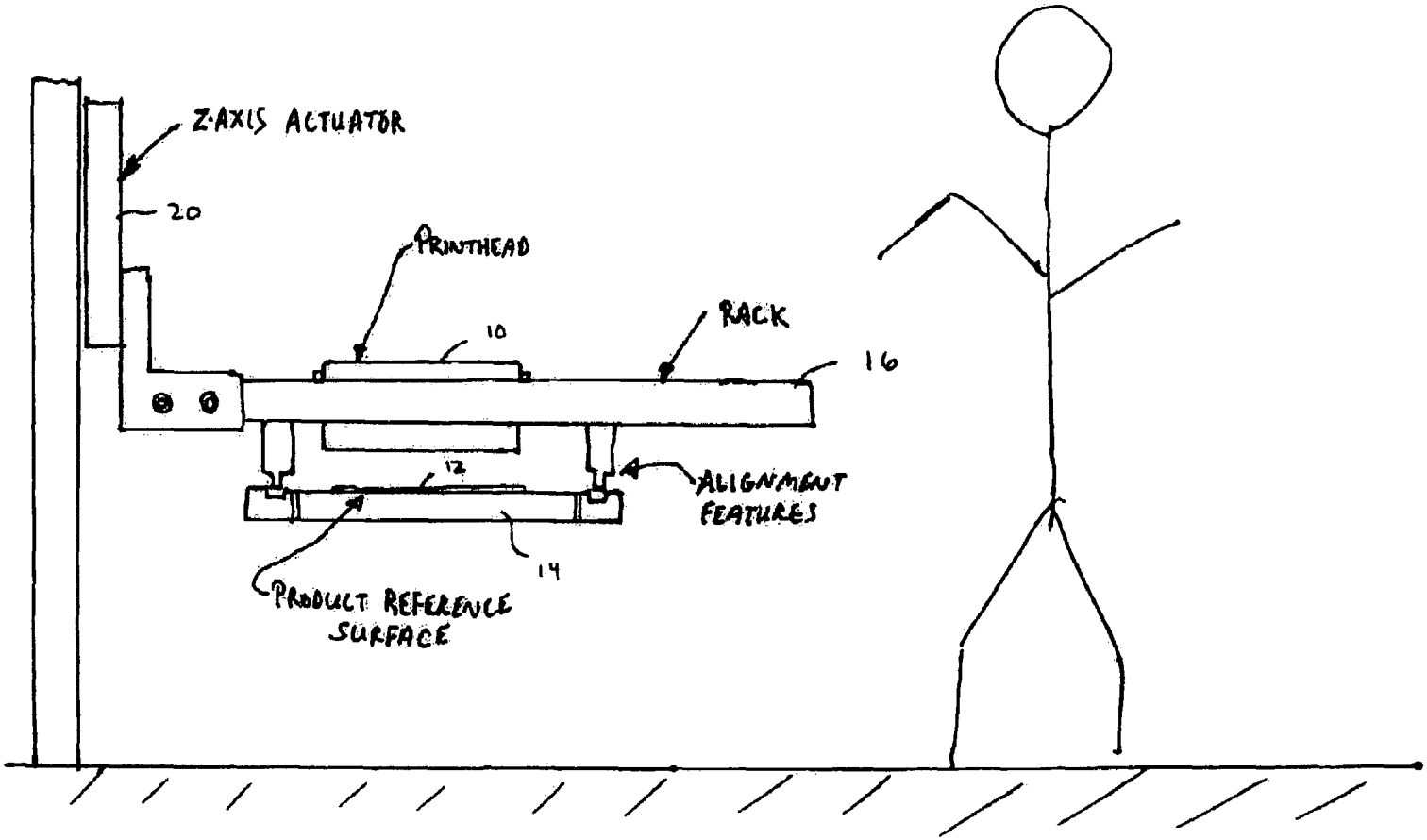
FIG. 2 is a side view of the printing assembly of FIG. 1.

Referring to FIGS. 1 and 2, print head clusters 10, here four in number, are used as part of a production process in which a substrate 12 is moved by a conveyor 14 beneath the print head clusters. In this embodiment, conveyor 14 supports substrates as wide as one to four feet and is capable of moving at speeds as high as 1600 feet/minute. Each of print head clusters 10 include an array of jetting assemblies, each of which is connected to one or more ink reservoirs. Print head clusters 10 print text or images upon the substrate as it passes beneath the print head clusters. Print head clusters 10 are supported by and movable on one end of a mounting rack 16 positioned over conveyor 14. In certain embodiments, the opposite end of mounting rack 16 is spaced a greater height from conveyor 14 and serves as a maintenance station when, for example, print head cluster 10 is serviced. Mounting rack 16 is attached to a support post 18 having a lift actuator 20. In this embodiment, lift actuator 20 is in the form of a servo-controlled lead screw assembly.

A sensor 22 includes a transmitter 24 mounted on one side of conveyor 10 and a receiver 26 mounted to an opposite side of the conveyor in an "electric-eye" arrangement. Transmitter 24 and receiver 26 are positioned a predetermined distance (e.g., 3-10 feet) from print head cluster 10. Transmitter 24 emits a beam of light a predetermined height (e.g., 1 or 2 mm and up to about 10 mm) above the surface of conveyor 14. If any portion of substrate 12 has a height that exceeds the spacing, the beam of light is interrupted and transmitter 24 sends a signal to lift actuator 20 to raise mounting rack 16 and print head clusters 10 an inch or more above the substrate and also provides a signal to print head clusters 10 to interrupt the printing process. For example, in one application, the substrate is a web of printable paper which may have a tear that extends from the surface of the paper such that it exceeds the pre-established spacing between the jetting assembly and the conveyor upon which the paper moves. Without increasing the displacement of the jetting assembly (e.g., raising the jetting assembly relative to the tear), the paper would collide with the jetting assembly.

The portion of substrate 12 with increased height is allowed to pass beneath print head cluster 10 and is diverted for disposal or reuse. Once the portion with increased height has passed beneath the print head clusters 10, lift actuator 20 lowers mounting rack 16 to its printing position. That being the case, lowering of the mounting rack and print head cluster is not only a function of when sensor 22 indicates that the increased height portion of substrate 12 has passed, but the distance the sensor is located from the print head cluster and the speed of conveyor 14. However, the mechanical structure used to support the print head clusters are not sufficiently rigid to ensure that the print head cluster will be in the exact position it was in prior to being raised. Therefore, an alignment system is required to accurately reposition the mounting rack 16 and print head clusters 10.

Figure 3:
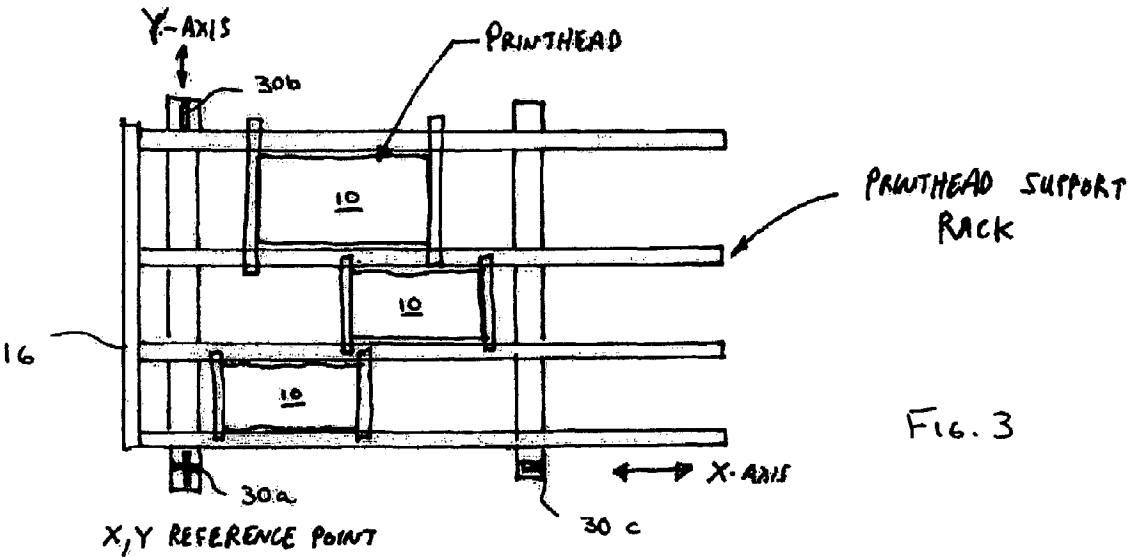
FIG. 3 is a top view of a mounting rack and print head clusters.
Figure 4:
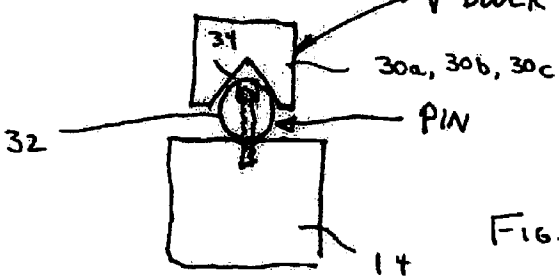
FIG. 4 is a cross-sectional side view of an alignment arrangement between the mounting rack of FIG. 3 and conveyor.

Referring to FIGS. 3 and 4, mounting rack 16 includes three alignment elements 30*a*, 30*b*, and 30*c*. Alignment element 30*a* is cruciform-shaped and serves as the reference point for re-positioning the mounting rack to the conveyor along both X and Y-axes. A second alignment element 30*b* spaced approximately one meter from alignment element 30*a* is elongated along the Y-axis and with alignment element 30*a* ensures accurate re-positioning along the Y-axis. Similarly, alignment element 30*c* spaced approximately one meter from alignment element 30*a* is elongated along the X-axis and with alignment element 30*a* ensures accurate re-positioning along the X-axis. Conveyor 14 includes spherically shaped locator pins 32 which are received within corresponding ones of alignment elements 30*a*, 30*b*, and 30*c*. Alignment elements 30*a*, 30*b*, and 30*c* are in the form of V-blocks, each having tapered edges 34 which serve as guiding surfaces for pins 32 as mounting rack 16 is lowered upon conveyor 14.

A number of embodiments of the invention have been described. Nevertheless, it will be understood that various modifications may be made without departing from the spirit and scope of the invention. For example, in the above embodiment, the substrate was in a continuous web of material and the variation in height could be caused by a tear or splice in the substrate. In other embodiments, the substrate can be in the form of individual products (e.g., food, ceramic tile) and the variation in height could be caused by an inappropriate orientation of the item (e.g., cocked, tilted).

The sensor system described above included an electric-eye arrangement of a transmitter receiver. Other sensors appropriate for use in detecting height variations include Transmissive sensors (e.g., LED/phototransistor pair), optical cameras, ultrasonic or x-ray sensors. Mechanical sensors including those having trip devices can also be substituted for the electric eye arrangement discussed above. Sensors that are combinations of optical and mechanical schemes can be used as well. For example, a cam device can be mechanically set for the thickness of the substrate. When the thickness of the substrate is in excess of the mechanically set cam (e.g., double thickness of a splice), the cam swings and raises a flag that trips an optical sensor.

Although four print head clusters were shown supported on mounting rack 16, in other embodiments, fewer or greater numbers of print head clusters can be positioned on mounting rack 16.

Accordingly, other embodiments are within the scope of the following claims.

What is claimed is:

1. A printing apparatus comprising:

a jetting assembly including a plurality of nozzles for ejecting droplets on a substrate moving relative to the jetting assembly;

a mounting rack to support the jetting assembly;

a mechanism comprising a servo-controlled lead screw assembly for changing the displacement of the mounting rack relative to the substrate; and a first alignment element associated with the mounting rack and a second alignment element associated with the substrate support, the second alignment element positionally corresponding with the first alignment element and being stationary relative to the substrate support, wherein the first alignment element being detachable from the second alignment element.

2. The apparatus of claim 1, wherein the mechanism further comprises a lift actuator.

3. The apparatus of claim 1 further comprising a conveyor for supporting the substrate.

4. The apparatus of claim 3, wherein the mechanism changes the displacement of the mounting rack with a speed based on the speed of the conveyor.

5. The apparatus of claim 1, further comprising a sensor configured to activate the mechanism for changing the displacement of the mounting rack relative to the substrate upon detecting a predetermined dimension of the substrate surface relative to the mounting rack.

6. The apparatus of claim 5, wherein the sensor comprises a receiver configured to receive signals from a transmitter and on the basis of those signals, activate the mechanism.

7. The apparatus of claim 6, further comprising the transmitter and a conveyer having a first side and a second, opposite side, the transmitter being mounted on the first side of the conveyer, and the receiver being mounted on the second, opposite side of the conveyor.

8. The apparatus of claim 1, wherein the first alignment element comprises V-blocks.

9. The apparatus of claim 1, wherein the second alignment element comprises locator pins configured to be received by the first alignment element.

10. The apparatus of claim 9, wherein the locator pins are in the form of spherical pins.

11. The apparatus of claim 1, wherein the mechanism changes the displacement of the mounting rack relative to the substrate with a speed based on the displacement of the mounting rack relative to the substrate.

12. A printing apparatus comprising:

a jetting assembly including a plurality of nozzles for ejecting droplets on a substrate moving relative to the jetting assembly;

a mounting rack to support the jetting assembly;

a mechanism for changing the displacement of the mounting rack relative to the substrate; and a first alignment element comprising V-blocks associated with the mounting rack and a second alignment element associated with the substrate support, the second alignment element positionally corresponding with the first alignment element and being stationary relative to the substrate support, wherein the first alignment element being detachable from the second alignment element.

13. The apparatus of claim 12, wherein the second alignment element comprises locator pins configured to be received by the first alignment element.

14. The apparatus of claim 13, wherein the locator pins are in the form of spherical pins.

15. The apparatus of claim 12, wherein the mechanism changes the displacement of the mounting rack relative to the substrate with a speed based on the displacement of the mounting rack relative to the substrate.

16. The apparatus of claim 12, further comprising a sensor configured to activate the mechanism for changing the displacement of the mounting rack relative to the substrate upon detecting a predetermined dimension of the substrate surface relative to the mounting rack.

17. The apparatus of claim 16, wherein the sensor comprises a receiver configured to receive signals from a transmitter and on the basis of those signals, activate the mechanism.

* * * * *